US006980156B2

(12) United States Patent
Komiyama

(10) Patent No.: US 6,980,156 B2
(45) Date of Patent: Dec. 27, 2005

(54) ANTENNA INSTALLATION STRUCTURE AND INFORMATION TERMINAL HAVING AN ANTENNA

(75) Inventor: Takehiko Komiyama, Kanagawa (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 10/369,600

(22) Filed: Feb. 21, 2003

(65) Prior Publication Data

US 2003/0160729 A1 Aug. 28, 2003

(30) Foreign Application Priority Data

Feb. 25, 2002 (JP) ..... 2002-047787

(51) Int. Cl.[7] ..... H01Q 1/24
(52) U.S. Cl. ..... 343/702; 343/888
(58) Field of Search ..... 343/702, 888

(56) References Cited

U.S. PATENT DOCUMENTS

| | | | | |
|---|---|---|---|---|
| 5,218,369 | A * | 6/1993 | Jennings | 343/702 |
| 5,233,363 | A | 8/1993 | Yarsunas et al. | |
| 5,859,617 | A * | 1/1999 | Fujikawa | 343/702 |
| 6,300,913 | B1 | 10/2001 | Davidson | |
| 6,426,724 | B2 * | 7/2002 | Gunee et al. | 343/702 |
| 6,707,430 | B2 * | 3/2004 | Sakaguchi et al. | 343/702 |

FOREIGN PATENT DOCUMENTS

| | | | |
|---|---|---|---|
| EP | 0 847 099 | A1 | 6/1998 |
| EP | 1 137 099 | A2 | 9/2001 |
| JP | S63-131211 | U | 8/1988 |
| JP | H08-250089 | A | 9/1996 |
| JP | H10-117224 | A | 5/1998 |
| JP | H11-4117 | A | 1/1999 |
| JP | H11-122033 | A | 4/1999 |
| JP | 2000-252727 | A | 9/2000 |
| JP | 2000-260405 | A | 9/2000 |
| JP | 2001-156513 | A | 6/2001 |
| WO | WO 02/11241 | A1 | 2/2002 |

* cited by examiner

*Primary Examiner*—Michael C. Wimer
(74) *Attorney, Agent, or Firm*—Sughrue Mion, PLLC

(57) ABSTRACT

For use with an antenna unit included in an antenna built-in type information terminal, the present invention provides an antenna unit structure that makes it possible to hold and assemble an antenna unit and to disassemble an antenna unit. The antenna unit structure is that a coiled spring and a pin terminal that is moved by the elasticity of the coiled spring is included in a power feeder. The antenna unit is fixed by latch hooks provided on the antenna unit and by a fixing pawl, a plurality of vibration preventing ribs, and a concave portion in an antenna installation part provided in a main body.

30 Claims, 6 Drawing Sheets

ANTENNA INSTALLATION STRUCTURE AND INFORMATION TERMINAL HAVING AN ANTENNA

BACKGROUND OF THE INVENTION

The present invention relates to an antenna installation structure of an information terminal, and more particularly to an installation structure of an antenna of an antenna built-in type information terminal.

Conventionally, a cellular phone is an example of an antenna built-in type information terminal. Some of cellular phones, which are of a folding type, have an antenna in the antenna-holding part of the main body for sending and receiving radio waves.

Some of conventional cellular phones have an antenna built in the main body. This built-in antenna is installed in the main body by soldering a straight built-in antenna or a coiled built-in antenna directly on the board or by fixing a plate-like antenna in the fixing position within the main body with a double-faced tape.

The problem with those antenna installation structures is that they require much installation labor and therefore long working hours.

SUMMARY OF THE INVENTION

It is an object of the present invention to provide an antenna installation structure, which makes it easy to hold or assemble an antenna and to disassemble an antenna, and an information terminal that has the antenna.

The antenna installation structure according to the present invention has an antenna unit including an antenna element and a power feeder; and an antenna installation part in which the antenna unit can be removably installed. The power feeder comprises a terminal moved by an elastic member. The antenna unit installation part is provided with end fixing means for fixing axial-direction ends of the antenna unit and vibration preventing means for preventing the antenna unit from vibrating in order to secure the antenna unit.

BRIEF DESCRIPTION OF THE DRAWINGS

The above and other objects, features and advantages of the present invention will become more apparent from the following detailed description when taken in conjunction with the accompanying drawings wherein.

DETAILED DESCRIPTION OF THE PREFERRED EMBODIMENTS

Figure 1:
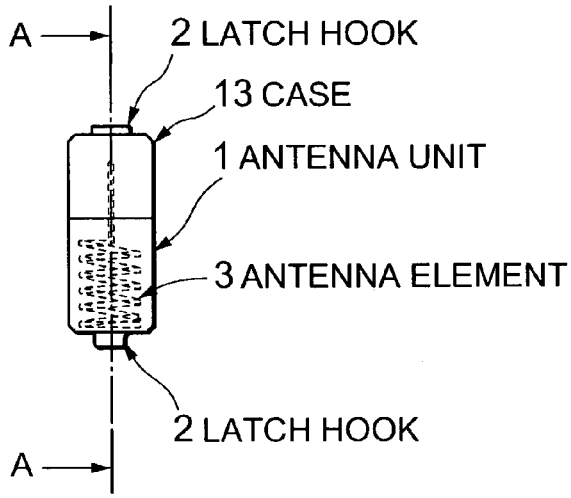
FIG. 1 is a plan view showing an antenna unit in a first embodiment.

FIG. 1 is a plan view showing an antenna unit in a first embodiment of the present invention. Referring to FIG. 1, an antenna unit 1 according to the present invention has a case 13 on which a plurality of latch hooks 2 are formed, and an antenna element 3 contained in the case 13.

Figure 2:
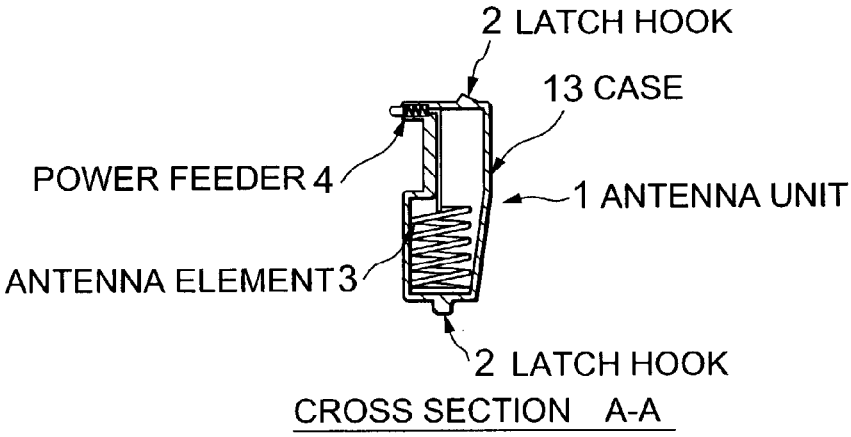
FIG. 2 is a cross sectional view taken on line A—A of the antenna unit in FIG. 1.
Figure 3:
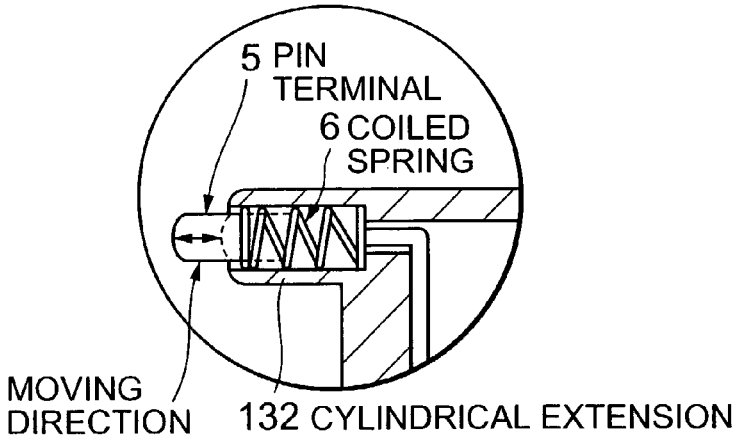
FIG. 3 is an enlarged view of a power feeder inside the antenna unit in the first embodiment.

FIG. 2 is a cross sectional view taken on line A—A of the antenna unit 1 shown in FIG. 1, and FIG. 3 is an enlarged cross sectional view of the power feeder inside the antenna unit 1. A power feeder 4 is composed of a terminal and an elastic member. The power feeder 4 is connected to a board, not shown, by the pressure of the elastic member. More specifically, a pin terminal 5 in a cylindrical extension 132 provided at one end of the case 13 is pressed by a coiled spring 6, which functions as the elastic member, to electrically connect an antenna element to the board. The elastic member may be a leaf spring.

Figure 4:
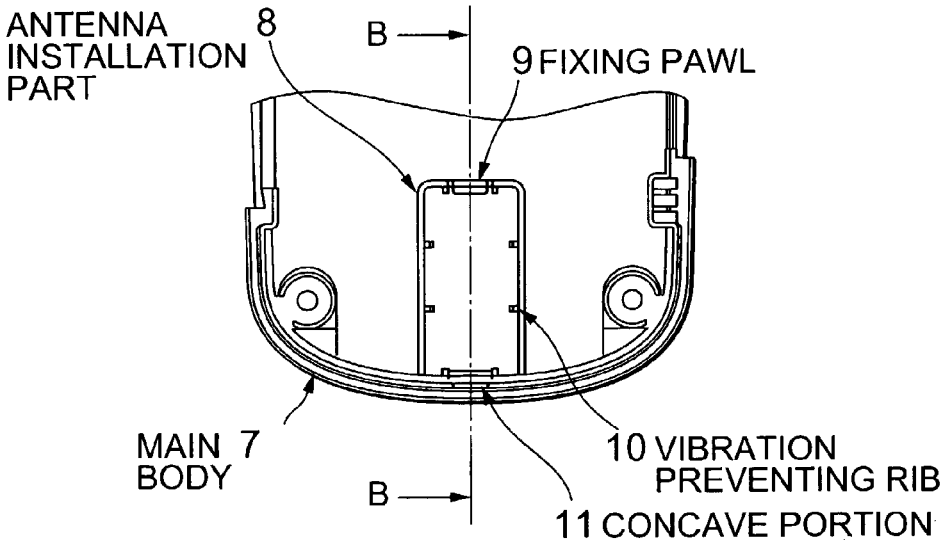
FIG. 4 is a plan view showing the detail of a cellular phone's antenna installation part in which the antenna unit is contained.
Figure 5:
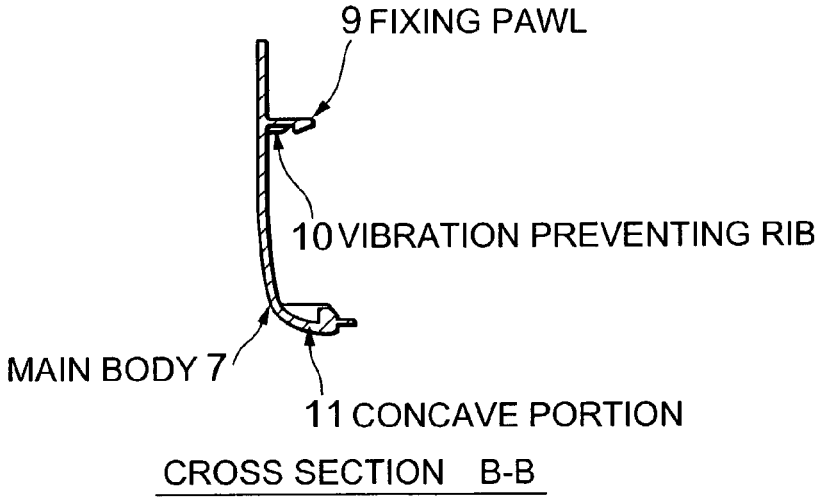
FIG. 5 is a cross sectional view taken on B—B of the antenna installation part shown in FIG. 4.
Figure 6:
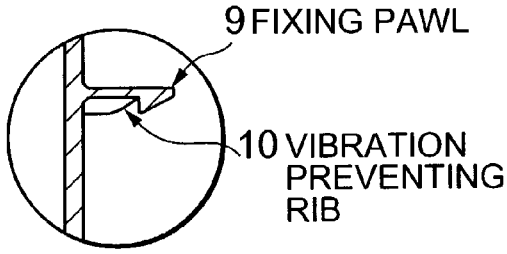
FIG. 6 is a partially enlarged view of FIG. 5.

FIG. 4 is a plan view showing the detail of a cellular phone's antenna installation part in which the antenna unit is contained, FIG. 5 is a cross sectional view taken on B—B of the antenna installation part shown in FIG. 4, and FIG. 6 is a partially enlarged view of FIG. 5. The antenna installation part 8 is provided at the bottom and inside a main body 7 of the cellular phone so that it is integrated with the main body. The latch hook 2 in the antenna unit 1 is engaged with a fixing pawl 9 in the antenna installation part 8.

A plurality of vibration preventing ribs 10 are provided in the circumferential portion of the frame of the antenna installation part 8 to secure the antenna unit in the correct position when it is stored. Instead of providing the antenna installation part 8 within the main body 7, the antenna unit may also be secured by a component such as a frame within the cellular phone.

Figure 7:
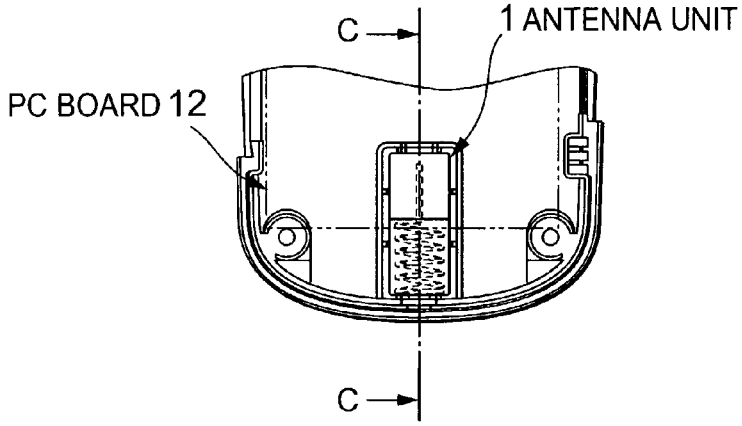
FIG. 7 is a plan view showing the detail of the antenna unit installed in the antenna installation part.
Figure 8:
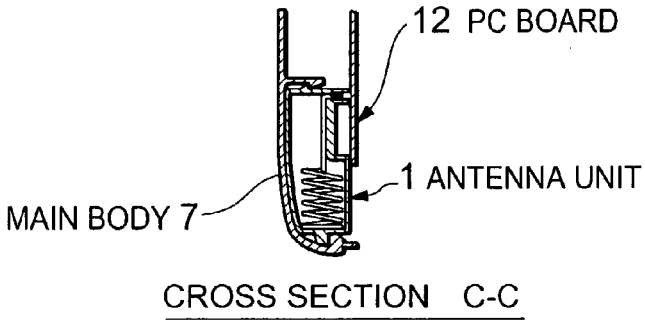
FIG. 8 is a cross sectional view taken on C—C of FIG. 7.
Figure 9:
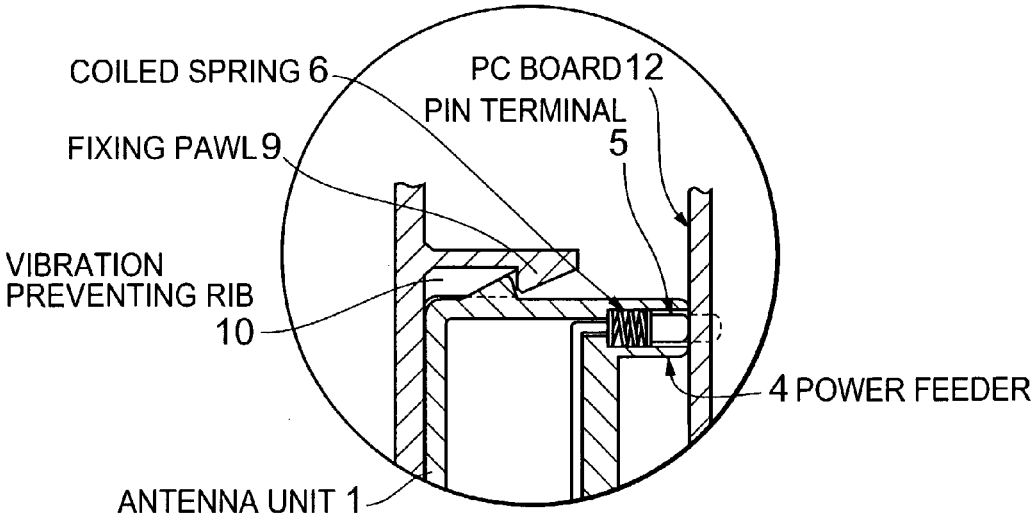
FIG. 9 is a partially enlarged view of FIG. 8.

FIG. 7 is a plan view showing the detail of the antenna unit installed in the antenna installation part, FIG. 8 is a cross sectional view taken on C—C of FIG. 7, and FIG. 9 is a partially enlarged view of FIG. 8.

As shown in FIG. 7, a printed circuit board 12 containing a radio circuit is installed in the main body 7 with the antenna unit is installed. The elasticity of the elastic coil spring 6 presses the moving pin terminal 5 against the printed circuit board and thus holds the printed circuit board 12 in contact with the pin terminal 5 to keep the antenna unit 1 electrically connected with the printed circuit board 12.

Figure 10:
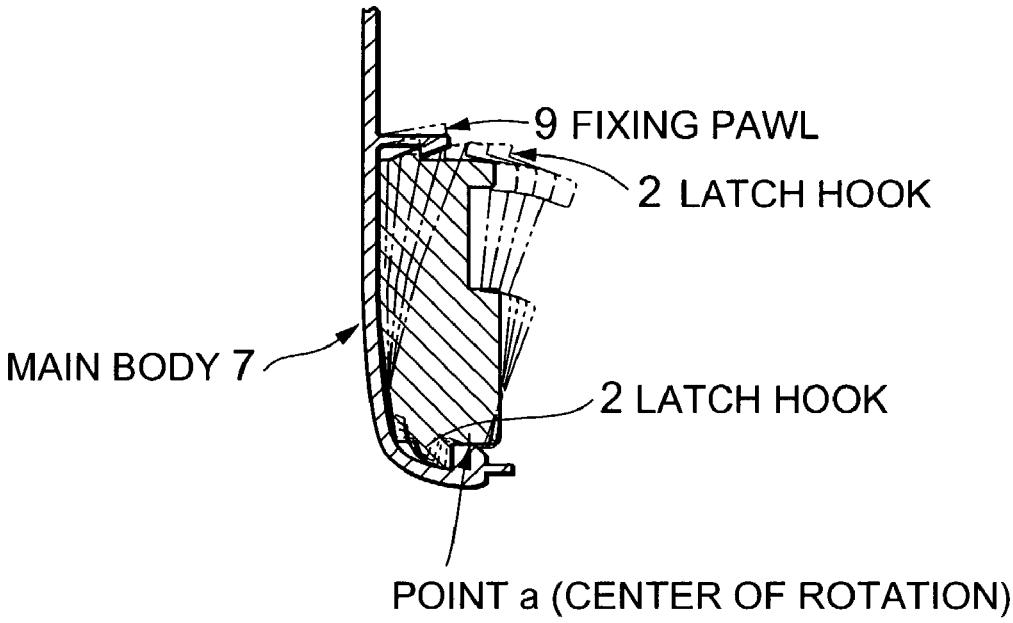
FIG. 10 is a cross sectional view showing how the antenna unit is held in the antenna installation part.
Figure 11:
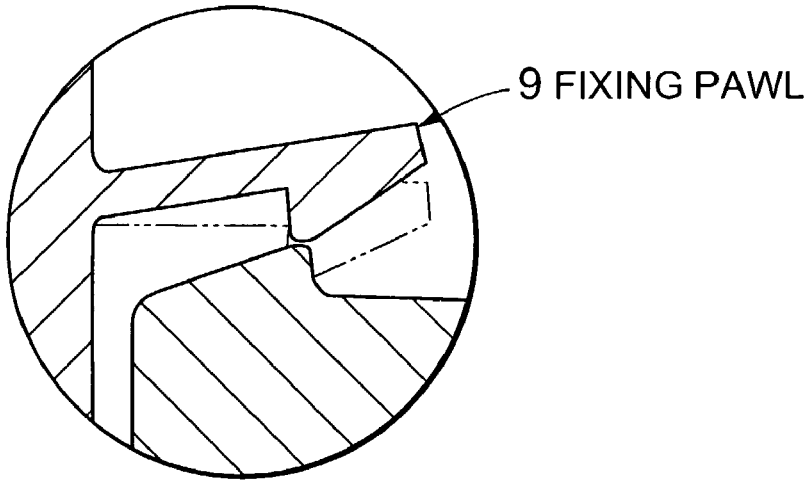
FIG. 11 is a partially enlarged view of FIG. 10.

To seat the antenna unit in the antenna installation part, do the following steps. As shown in FIG. 10, slightly tilt the antenna unit and engage the bottom latch hook 2 with the concave portion of the antenna installation part. Then, push the top latch hook 2 into the antenna installation part 8 while rotating the antenna unit with point a as the center of rotation. At this time, the fixing pawl 9, which is pressed by the inclined face of the latch hook 2, is bent as shown in FIG. 11. After passing over the maximum bending point, the fixing pawl 9 returns to its original position to engage itself with the latch hook 2.

Figure 12:
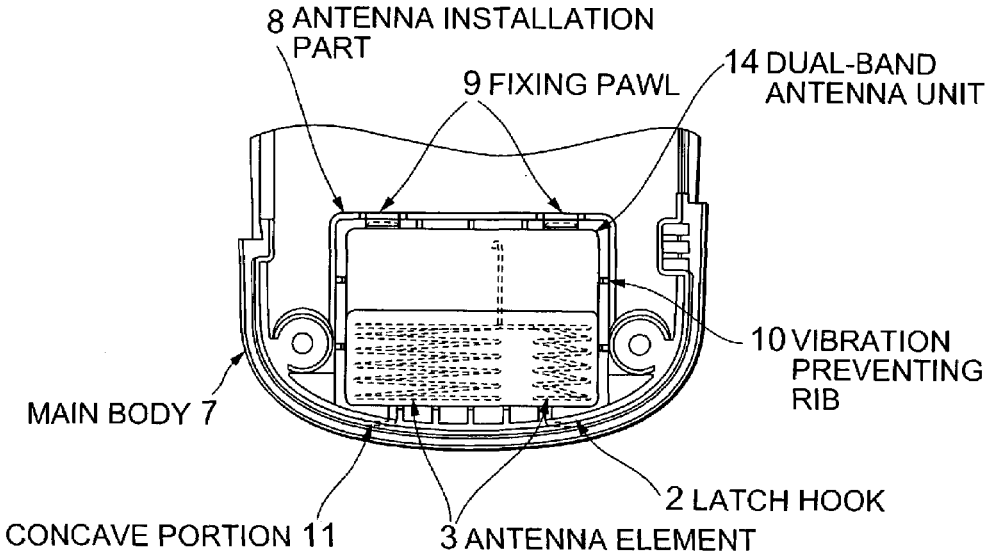
FIG. 12 is a diagram showing the configuration of a second embodiment.
Figure 13:
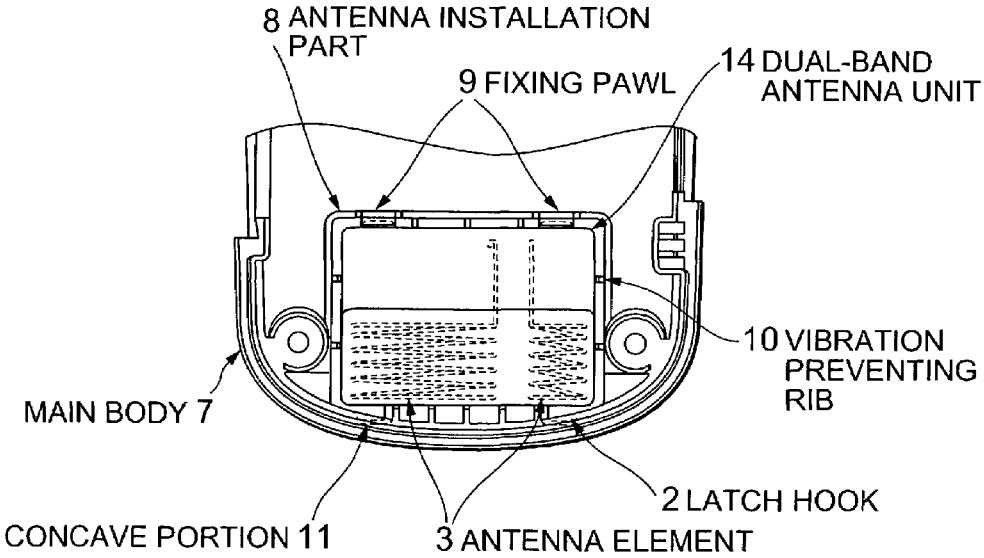
FIG. 13 is a diagram showing the configuration of the second embodiment.

FIG. 12 and FIG. 13 are diagrams showing the configuration of a second embodiment of the present invention. The antenna unit according to this invention has a plurality of latch hooks 2 on the case. The unit has two or more antenna elements and power feeders in the case, each corresponding to a frequency band.

Figure 14:
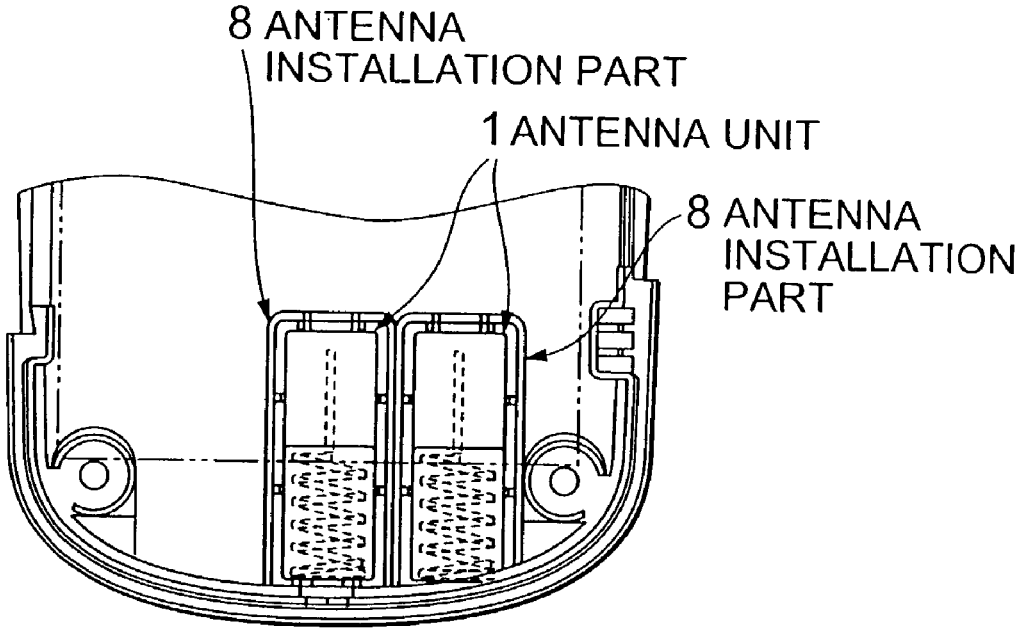
FIG. 14 is a diagram showing the configuration of the second embodiment.

Referring to FIG. 14, a plurality of antenna units, each composed of one or more antenna elements and power feeders, are contained in the antenna installation part and those antenna units are contained in separate cases each with a plurality of latch hooks.

As described above, the antenna unit according to the present invention has a moving pin terminal in the power feeder thereof to connect the antenna unit with the printed circuit board. This makes it possible to easily assemble an antenna without soldering and to easily remove (disassemble) the antenna unit.

Increased accuracy in the shape of the antenna installation part increases the accuracy of the antenna position, thus ensuring the reliable antenna unit position.

Building an antenna unit in a cellular phone eliminates the need for a cylinder-like swell found on a conventional cellular phone that has a telescopic antenna. This reduces cellular phone design limitations.

While this invention has been described in connection with certain preferred embodiments, it is to be understood that the subject matter encompassed by way of this invention is not to be limited to those specific embodiments. On the contrary, it is intended for the subject matter of the invention to include all alternatives, modifications and equivalents as can be included within the spirit and scope of the following claims.

What is claimed is:

1. An antenna installation structure comprising:

an antenna unit including an antenna element and a power feeder; and an antenna installation part in which said antenna unit can be removably installed, said antenna installation part comprising fixing means for fixing said antenna unit in said antenna installation part, and said fixing means comprising, end fixing means for fixing axial-direction ends of said antenna unit, said end fixing means fixing said antenna unit by latch hooks provided on said antenna unit and by a fixing pawl and a concave portion provided in said antenna installation part; and vibration preventing means for preventing said antenna unit from vibrating.

2. The antenna installation structure according to claim 1, wherein said antenna unit is pressed by a board, on which an electric circuit is mounted, to electrically connect to said board.

3. The antenna installation structure according to claim 1, wherein said antenna unit has a plurality of antenna elements.

4. The antenna installation structure according to claim 2, wherein said antenna unit has a plurality of antenna elements.

5. An antenna installation structure according to claim 1, wherein said power feeder comprises a moving terminal, and said terminal is moved by an elastic member.

6. An antenna installation structure comprising:

an antenna unit including an antenna element and a power feeder; and an antenna installation part in which said antenna unit can be removably installed, said antenna installation part comprising fixing means for fixing said antenna unit in said antenna installation part, and said fixing means comprising, end fixing means for fixing axial-direction ends of said antenna unit; and vibration preventing means for preventing said antenna unit from vibrating, said vibration preventing means having ribs in said antenna installation part to prevent said antenna unit from vibrating.

7. The antenna installation structure according to claim 6, wherein said antenna unit is pressed by a board, on which an electric circuit is mounted, to electrically connect to said board.

8. The antenna installation structure according to claim 6, wherein said antenna unit has a plurality of antenna elements.

9. The antenna installation structure according to claim 7, wherein said antenna unit has a plurality of antenna elements.

10. An antenna installation structure according to claim 6, wherein said power feeder comprises a moving terminal, and said terminal is moved by an elastic member.

11. An information terminal comprising:

an antenna unit including an antenna element and a power feeder; and an antenna installation part in which said antenna unit can be removably installed, said antenna installation part comprising fixing means for fixing said antenna unit, and said fixing means comprising, end fixing means for fixing axial-direction ends of said antenna unit, said end fixing means fixing said antenna unit by latch hooks provided on said antenna unit and by a fixing pawl and a concave portion provided in said antenna installation part; and vibration preventing means for preventing said antenna unit from vibrating.

12. An information terminal according to claim 11, wherein said information terminal has a main body and said antenna installation part is provided in said main body.

13. An information terminal comprising:

an antenna unit including an antenna element and a power feeder; and an antenna installation part in which said antenna unit can be removably installed, said antenna installation part comprising fixing means for fixing said antenna unit, and said fixing means comprising, end fixing means for fixing axial-direction ends of said antenna unit; and vibration preventing means for preventing said antenna unit from vibrating, said vibration preventing means having ribs in said antenna installation part to prevent said antenna unit from vibrating.

14. An information terminal according to claim 13, wherein said information terminal has a main body and said antenna installation part is provided in said main body.

15. An antenna installation structure comprising:

an antenna; and an antenna installation part where said antenna can be removably installed, said antenna installation part fixing axial-direction ends of said antenna and comprising, a fixing pawl; and a concave portion, wherein said antenna installation part fixes said antenna by latch hooks provided on said antenna, said fixing pawl, and said concave portion.

16. An antenna installation structure according to claim 15, wherein said antenna includes a power feeder, said power feeder comprises a moving terminal, and said terminal is moved by an elastic member.

17. An antenna installation structure according to claim 15, wherein said antenna is pressed by a board on which an electric circuit is mounted, to electrically connect to said board.

18. An antenna installation structure according to claim 15, wherein said antenna has a plurality of antenna elements.

19. An antenna installation structure comprising:

an antenna; and an antenna installation part where said antenna can be removably installed, said antenna installation part fixing axial-direction ends of said antenna and comprising, a fixing pawl; and a concave portion, wherein said antenna installation part fixes said antenna by said fixing pawl and said concave portion which are engaged with latch hooks provided on said antenna.

20. An antenna installation structure according to claim 19, wherein said antenna includes a power feeder, said power feeder comprises a moving terminal, and said terminal is moved by an elastic member.

21. An antenna installation structure according to claim 19, wherein said antenna is pressed by a board on which an electric circuit is mounted, to electrically connect to said board.

22. An antenna installation structure according to claim 19, wherein said antenna has a plurality of antenna elements.

23. An antenna installation structure comprising:

an antenna unit including an antenna element and a power feeder; and an antenna installation part where said antenna unit can be removably installed, said antenna installation part fixing said antenna unit in said antenna installation part and comprising, a fixing pawl;

a concave portion; and a vibration preventing part which prevents said antenna unit from vibrating, wherein said antenna installation part fixes axial direction ends of said antenna unit by latch hooks provided on said antenna unit, said fixing pawl, and said concave portion.

24. An antenna installation structure according to claim 23, wherein said power feeder comprises a moving terminal, and said terminal is moved by an elastic member.

25. An antenna installation structure according to claim 23, wherein said antenna is pressed by a board on which an electric circuit is mounted, to electrically connect to said board.

26. An antenna installation structure according to claim 23, wherein said antenna unit has a plurality of antenna elements.

27. An antenna installation structure comprising:

an antenna unit including an antenna element and a power feeder; and an antenna installation part where said antenna unit can be removably installed, said antenna installation part fixing said antenna unit in said antenna installation part and comprising, an end fixing part which fixes axial-direction ends of said antenna unit; and ribs which prevent said antenna unit from vibrating.

28. An antenna installation structure according to claim 27, wherein said power feeder comprises a moving terminal, and said terminal is moved by an elastic member.

29. An antenna installation structure according to claim 27, wherein said antenna is pressed by a board on which an electric circuit is mounted, to electrically connect to said board.

30. An antenna installation structure according to claim 27, wherein said antenna unit has a plurality of antenna elements.

* * * * *